United States Patent [19]

Schmidt

[11] 4,382,727

[45] May 10, 1983

[54] CONTOUR COPYING MACHINE

[75] Inventor: Erich Schmidt, Mauerbach, Austria

[73] Assignee: Maschinenfabrik Zuckermann Komm. Ges., Vienna, Austria

[21] Appl. No.: 186,660

[22] Filed: Sep. 12, 1980

[30] Foreign Application Priority Data

Sep. 14, 1979 [DE] Fed. Rep. of Germany ..... 2937249

[51] Int. Cl.[3] ..... S27C 5/00

[52] U.S. Cl. ..... 409/105; 51/140; 51/145 R; 142/7; 144/144 R

[58] Field of Search ..... 142/3, 4, 6, 7, 11, 142/13, 10, 15, 37; 144/137, 154, 144 R; 51/34 A, 50 PC, 140, 142, 145 R; 409/104, 105

[56] References Cited

U.S. PATENT DOCUMENTS

| | | | |
|---|---|---|---|
| 1,299,350 | 4/1919 | Janes | 409/105 |
| 3,960,188 | 6/1976 | Schmidt | 144/144 R |
| 4,002,193 | 1/1977 | Schmidt | 144/144 R |
| 4,112,628 | 9/1978 | Schmidt | 51/140 |
| 4,219,974 | 9/1980 | Schmidt | 51/145 R |

FOREIGN PATENT DOCUMENTS 2311011 9/1973 Fed. Rep. of Germany .

*Primary Examiner*—W. D. Bray

*Attorney, Agent, or Firm*—Finnegan, Henderson, Farabow, Garrett & Dunner

[57] ABSTRACT

An improvement in a contour copying machine having means for supporting at least one pattern and at least one workpiece rotatably about parallel respective pattern and workpiece longitudinal axes, means for synchronously rotating the pattern and the workpiece about the respective axes, at least one copying roller engageable with the pattern, and at least one tool engageable with the workpiece, the copying roller and the tool being rigidly interconnected and synchronously movable about the respective longitudinal axes, and means for urging the copying roller and the tool against the pattern and the workpiece, respectively, for machining the workpiece and accurately reproducing therein the contours of the pattern, the improvement comprising: a rigid support frame for supporting and rigidly interconnecting the copying roller and the tool in proximate relation to one another, traction means connected to the support frame at points thereon situated symmetrically with respect to the copying roller, and biasing means operatively connected to the traction means, the means for urging the copying roller and the tool against the pattern and the workpiece, respectively, including the support frame, the traction means and the biasing means.

14 Claims, 5 Drawing Figures

CONTOUR COPYING MACHINE

FIELD OF THE INVENTION

This invention relates to a contour copying machine for grinding or milling workpieces of wood or a similarly machineable material, in which at least one pattern (model) and at least one workpiece are mounted in mutually spaced relation parallel to one another between clamping devices so as to be rotatable about the longitudinal axis thereof and driven in synchronism, the pattern being associated with a copying roller and the workpiece being associated with a tool, said copying roller and said tool being are rigidly interconnected to form a pivotal, movable unit and mounted to be displaced along the longitudinal axis of said workpiece with the aid of guide means for machining said workpiece true to shape, both said copying roller and tool being resiliently pre-biased towards the pattern and workpiece, respectively, in order to ensure accurate engagement of said copying roller and tool.

DESCRIPTION OF THE PRIOR ART

German Offenlegungsschrift DE-OS No. 2,311,011 reveals a contour copying machine of the afore-cited type. It includes a pattern and two workpieces which are respectively proximate to the pattern. Both belt grinding units and milling cutters are provided for machining the workpieces. Each workpiece is simultaneously machined at the top and bottom, i.e. there is an upper tool group which, together with the copying roller, constitutes a movable unit, and there is a lower tool group which forms a unit together with the lower copying roller. The tools and the copying roller are respectively mounted at the one end of a support arm, the other end thereof supporting axle journals which are aligned transversely to the support arm axis. The axle journals are interconnected rigidly so that each of the two tool groups has a common pivotal axis about which the copying roller and the proximate tools can be pivoted during machining of the workpieces and copying of the pattern. The movable unit is mounted with the common pivotal axis in lateral guide shears which are adapted to be displaced in the longitudinal direction of the workpieces. This arrangement makes it possible to transfer the shape of the pattern to the workpieces true to scale over the entire length thereof.

SUMMARY OF THE INVENTION

The object of the present invention is to improve the known contour copying grinding and milling machine to such an extent that a plurality of workpieces can be copy-machined at the same time without having to fear a deterioration in the quality of the true-to-scale transfer of the respective shape.

The difficulty encountered in contour copying operations is that they cannot be employed unless there is a guarantee that the shape of the pattern will in fact be transferred to the workpieces true to scale. For reasons of economy, interest focuses on simultaneously producing as many workpieces as possible using one pattern. The problem addressed by the invention is to find a common solution for both of the afore-mentioned demands.

The above-mentioned object is accomplished in that the machine includes a support frame for accommodating a plurality of tools each associated with at least one copying roller, said tools and said copying roller being mounted on said support frame in proximate relation to one another and said support frame being connected to traction elements at points symmetrical to said copying roller, said traction elements being acted upon by a common pre-biasing spring.

A plurality of tools such as grinding or milling units is provided in the present machine. In certain embodiments as many as ten or more tool units are mounted next to one another. The support frame receives the tools and the copying roller(s) associated therewith, thereby forming a movable unit with these parts. The support frame can be designed to be resistant to torsion, thereby ensuring that even the outer tools will execute the same movements as the tools nearer the middle of the frame so that true-to-shape pattern imitation can be achieved with all workpieces.

To adequately adapt the tools and the copying roller to the workpieces and to the pattern, respectively, the invention provides a common pre-biasing spring whose force is exerted onto the support frame by means of traction elements symmetrically engaging the same. These traction elements act like guides, allowing the support frame to be controlled in its copying movement. The traction elements also impart additional stiffness to the frame.

It is obvious that the invention is not restricted solely to the use of grinding and milling units. Other suitable tools can also be mounted on the support frame. It is equally feasible that a plurality of tools can be simultaneously associated with the workpieces, e.g. a group of milling units which machine the workpieces at the top producing the rough cut, then a first group of grinding units which machine the workpieces at the bottom producing a coarse grinding operation followed by yet another group of grinding units which finish the workpieces at the top.

All of these tool groups can be mounted on common guide means to enable them to be displaced along the longitudinal axes of the workpieces.

It is advantageous if the pattern is located at the center of the support frame. This results in a symmetrical arrangement of the tools. They are provided in equal numbers to the right and left of the pattern. This means that the forces acting on the support frame are also distributed symmetrically as well. It is advisable to position the pre-biasing spring in a vertical plane parallel to the longitudinal axis of the workpiece which passes through the pattern.

It is also advantageous to form the traction elements of ropes. Ropes can be guided easily about pulleys or sheaves, but nonetheless have stable dimensions and permit exact control of the support frame. It is possible, however, to design the traction elements as chains. No expansion in the direction of pull need be feared in this case. Chains are also advantageous in that they can be guided exactly by chain wheels.

It is contemplated in accordance with the invention that the guide means are formed of known guide shears mounted to be displaced and driven on guides in the longitudinal direction of the workpiece. The guide shears support between themselves the support frame which is aligned transversely to the longitudinal direction of the workpieces.

It is advantageous if the pre-biasing spring is attached to a support interconnecting said two guide shears.

A favorable further development of the invention is that the traction elements extend from said support frame to a wind-up roller and are normally wound up thereon, the roller being non-rotatably mounted on a common shaft which is rotatably mounted in said guide shears in each case. The wind-up rollers serve to receive the traction elements and constitute a storage means therefor. The shaft permits both wind-up rollers and thus both traction elements to be centrally wound up in a uniform manner. The pre-biasing spring can readily engage the shaft in the direction of load exertion with the aid of a lever or a wheel.

In order to provide a stabilizing counterforce to counteract the pre-biasing spring, it is advantageous if counteracting springs are provided between the support frame and the guide shears.

In a preferred embodiment, the support frame can be pivotally mounted on the guide shears via parallel guide bars. It is also advantageous, however, to mount the support frame so that it can reciprocate on said guide shears via parallel guides. Exact coupling between the guide shears and the support frame is ensured in both cases.

BRIEF DESCRIPTION OF THE DRAWING

Embodiments of the invention will now be described in detail in the following paragraphs with reference to a drawing, in which.

DESCRIPTION OF THE PREFERRED EMBODIMENT

Figure 1:
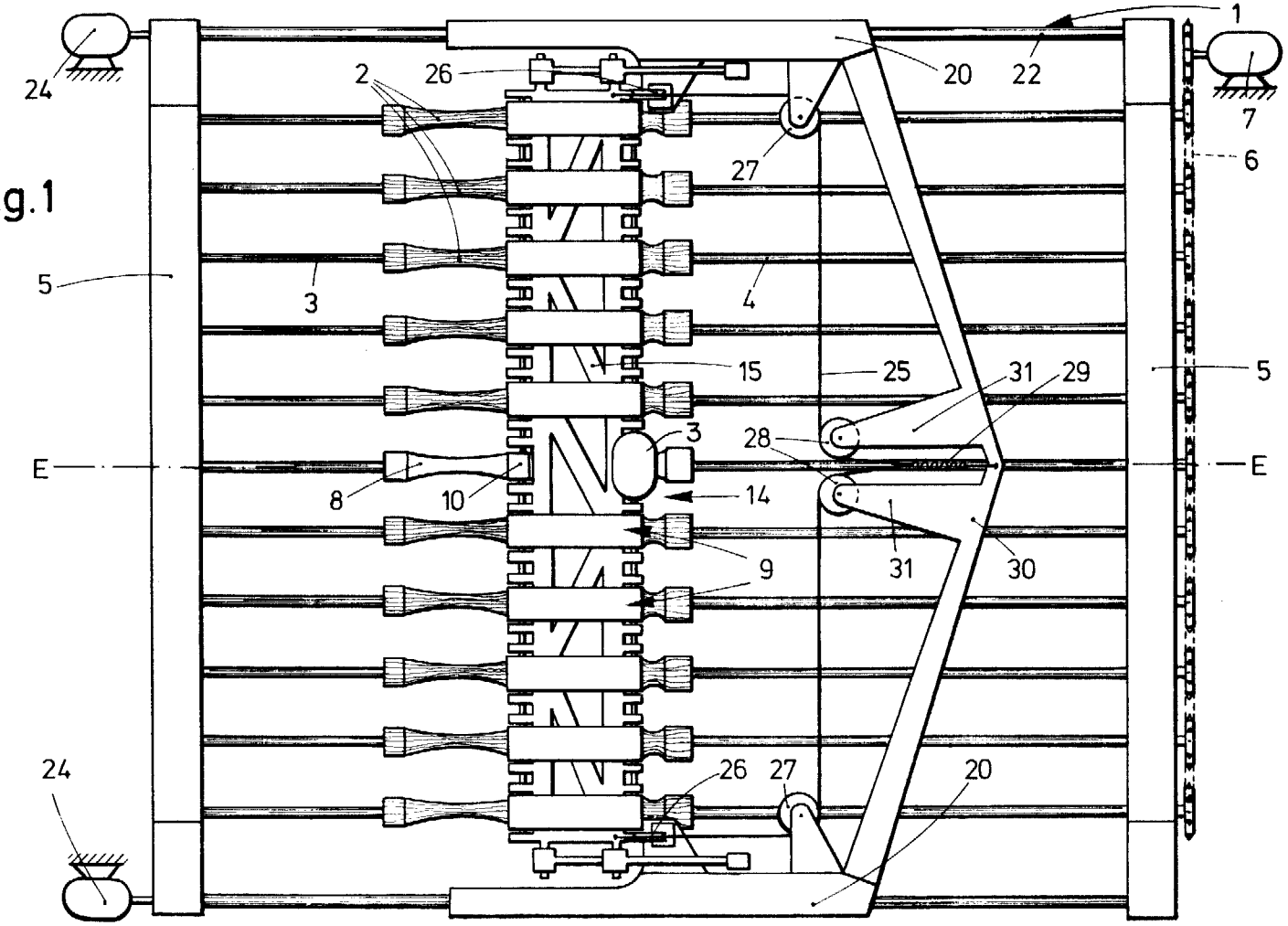
FIG. 1 is a top elevation of a copying metal-cutting machine in which only a top group of tools is shown, FIG. 2 are sectional views through an upper and a lower group of tools along lines II—II in FIGS. 3 and 4.

FIG. 1 illustrates a contour copying machine 1 which serves for the grinding of workpieces 2. The workpieces shown consist of wood, but may consist of a similarly machineable material. In the present case, the workpieces are balusters for making a stairway. They have an irregular shape with a flourished surface configuration.

In the case illustrated, the workpieces are aligned so that their grain coincides with the longitudinal direction L of the body and are mounted in a machine frame 5 at both ends with the aid of clamping devices 3 and 4 to permit rotation about their longitudinal axes. They can be driven in synchronism with the aid of a chain drive 6 and a motor 7.

In the present case, five workpieces 2 are clamped in position on each side of a pattern 8 located in the center of the machine. The pattern 8 is also mounted between clamping devices 3, 4 like the workpieces and is driven by chain drive 6 which rotates it during the machining operation in synchronism with the workpieces 2.

Figure 3:
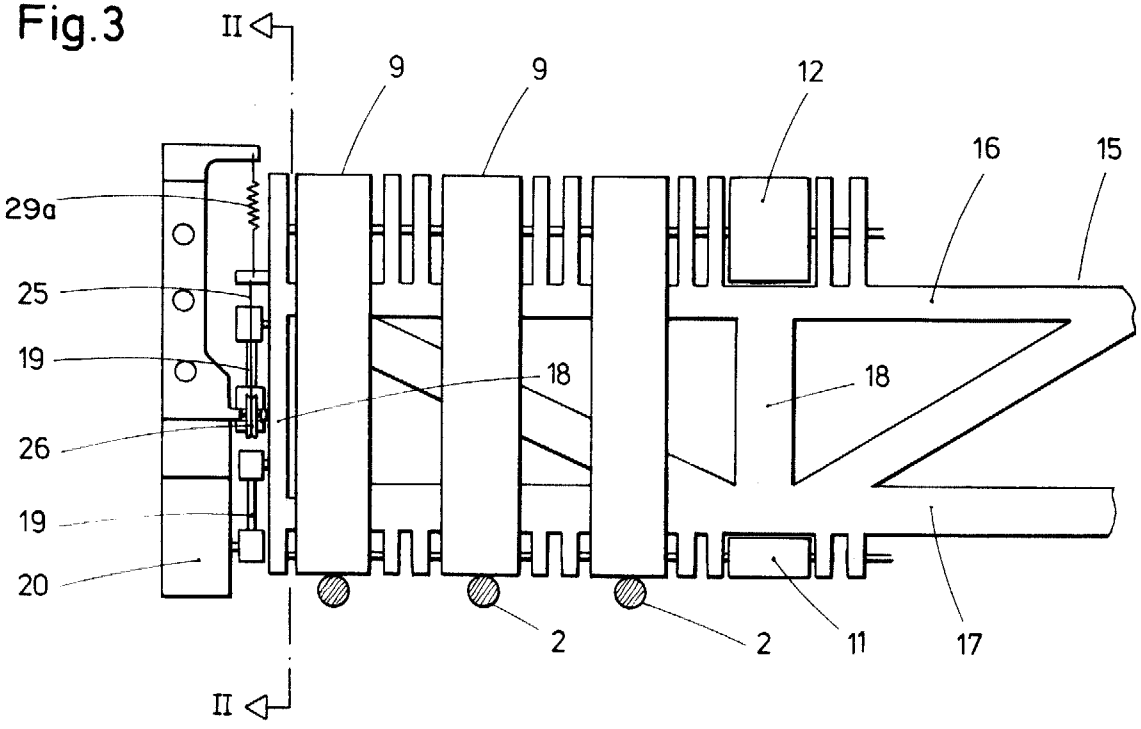
FIG. 3 is a front elevation of the left end of the upper tool group according to elevation A in FIG. 2.

As revealed in FIG. 1, the pattern 8 and the workpieces 2 are disposed parallel to one another in a constant spaced relation to one another. Each workpiece is associated with a belt grinding unit 9, whereas the pattern 8 is associated with a copying roller 10. The belt grinding units each have a small guide roller 11 which is closer to the workpiece and a more remote, large guide roller 12 about which an endless grinding belt moves. The smaller roller idles, while the axes of the large guide rollers 12 are interconnected and driven by a common central motor 13. The grinding units 9 shown in FIG. 1 constitute an upper tool group 14 which is mounted on a common support frame 15. The copying roller has a diameter which is the thickness of the grinding belt larger than the small guide rollers 11 and rotates together therewith about a common, ideal, horizontal axis A. FIGS. 1 and 3 reveal that the support arm consists of an upper chord 16 and a lower chord 17 which are interconnected by vertical and oblique webs 18 so as to prevent torsion. The support frame 15 together with the belt grinding units 9 and the copying roller 10 constitutes a movable unit which permits the shape of the pattern 8 to be transferred exactly to the workpieces. During operation, the copying roller 10 abuts against the pattern and traces the same over its entire length and external surface as the machining operation progresses. The support frame transfers these traced movements to the tools, thus making it possible to form out of the workpieces true-to-shape imitations of the pattern.

In the upper workpiece group 14 shown in FIGS. 1 and 3, the support frame which is aligned transversely to the longitudinal axis L of the workpieces is guided on both sides with the aid of two parallel guide bars 19. The bars are each pivotally mounted at one end on the side of the support frame, while the other end is pivotally mounted on the lateral guide shears 20 which flank the support frame and form a guide means for the upper tool group 14.

In the present case, the parallel guide bars 19 are disposed such that the upper tool group and the support frame 15 form an acute angle $\alpha$ relative to the vertical.

The guide shears 20 are each supported by two tiered guide rods 21 and 22 which are parallel to one another and have their ends immovably secured in the frame 5. A spindle (driving screw) 23 is provided between the guide rods for moving the guide shears 20 in the longitudinal direction L of the workpieces. A motor 24 serves as a drive means. A traction element 25 designed as a rope is secured to the support frame in both end areas thereof. The rope extends from its point of attachment downwardly to a first guide roller 26 mounted on the guide shears and then to a second guide roller 27 from whence it extends transversely to the longitudinal direction L of the workpieces to a third guide roller 28. After passing about this roller, the ropes which arrive from both opposing guide shears converge towards a common pre-biasing spring 29 which is attached at its other end to a support 30. The support 30 establishes a rigid connection between the two guide shears 20. The guide rollers 28 are provided on forwardly projecting arms 31 of the support 30. The pre-biasing spring 29 acts in the direction of adjustment, i.e. it pre-biases the tools and the copying roller towards the pattern or workpieces.

These pre-biasing springs 29 are counteracted by two other springs **29*a* which are also provided on the support frame in both lateral end areas and which have their other ends anchored to the guide shears 20**.

The counteracting springs **29*a*, which are not shown in FIG. 1** for reasons of clarity, compensate for the load acting on the support frame and ensure sufficient basic tension when controlling the movement of the support frame.

It is evident from FIG. 1 that both the support frame, the support and the pre-biasing spring are disposed symmetrically about in a vertical plane E which is parallel to the longitudinal axis of the workpieces and which passes through the pattern. The counteracting springs are also located symmetrically about this plane E.

Figure 2:
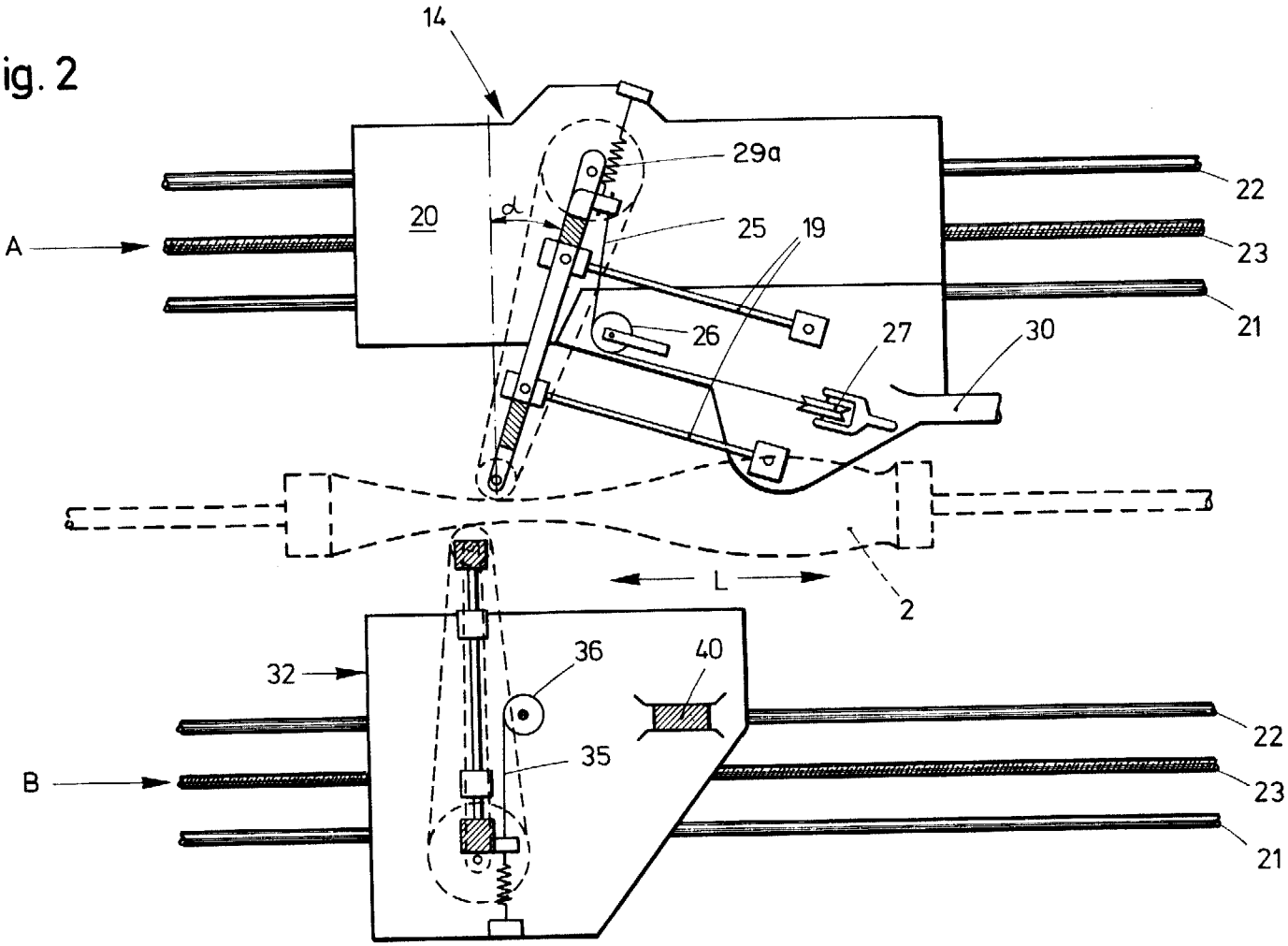
Figure 4:
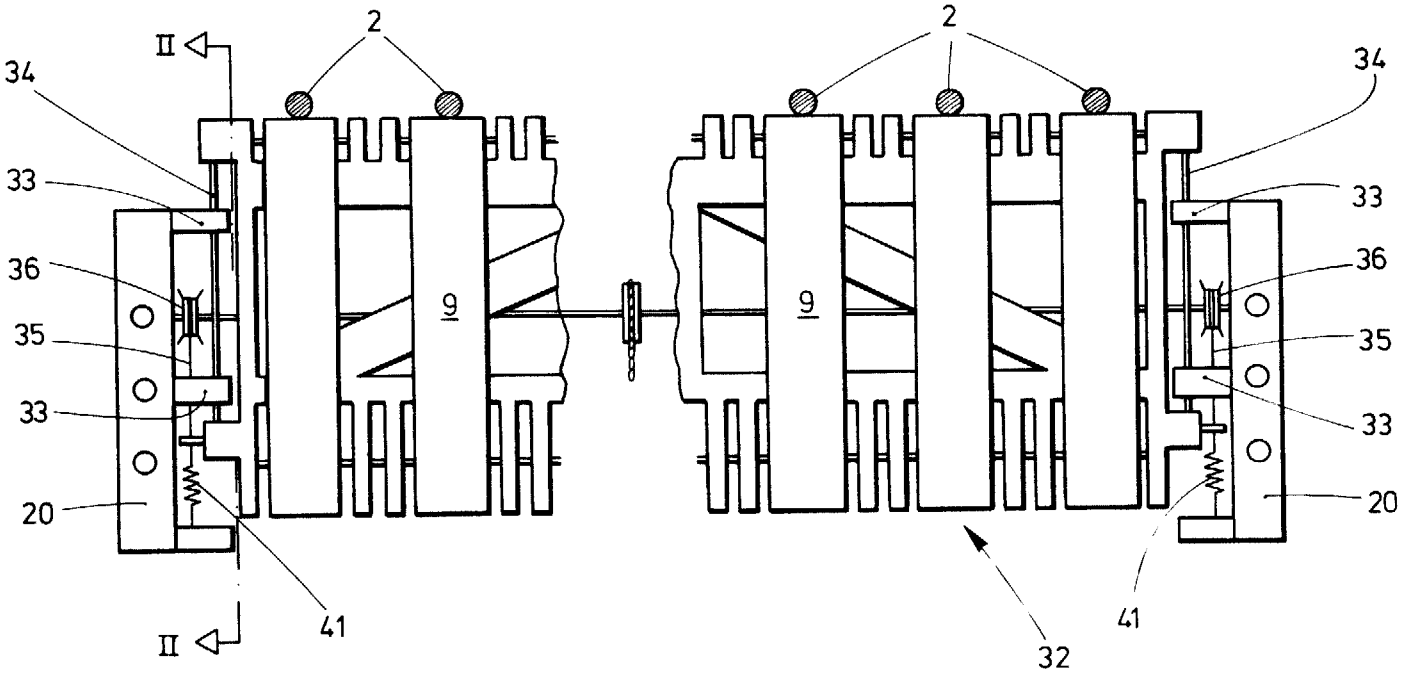
FIG. 4 is a front elevation of the lower tool group according to elevation B in FIG. 2.
Figure 5:
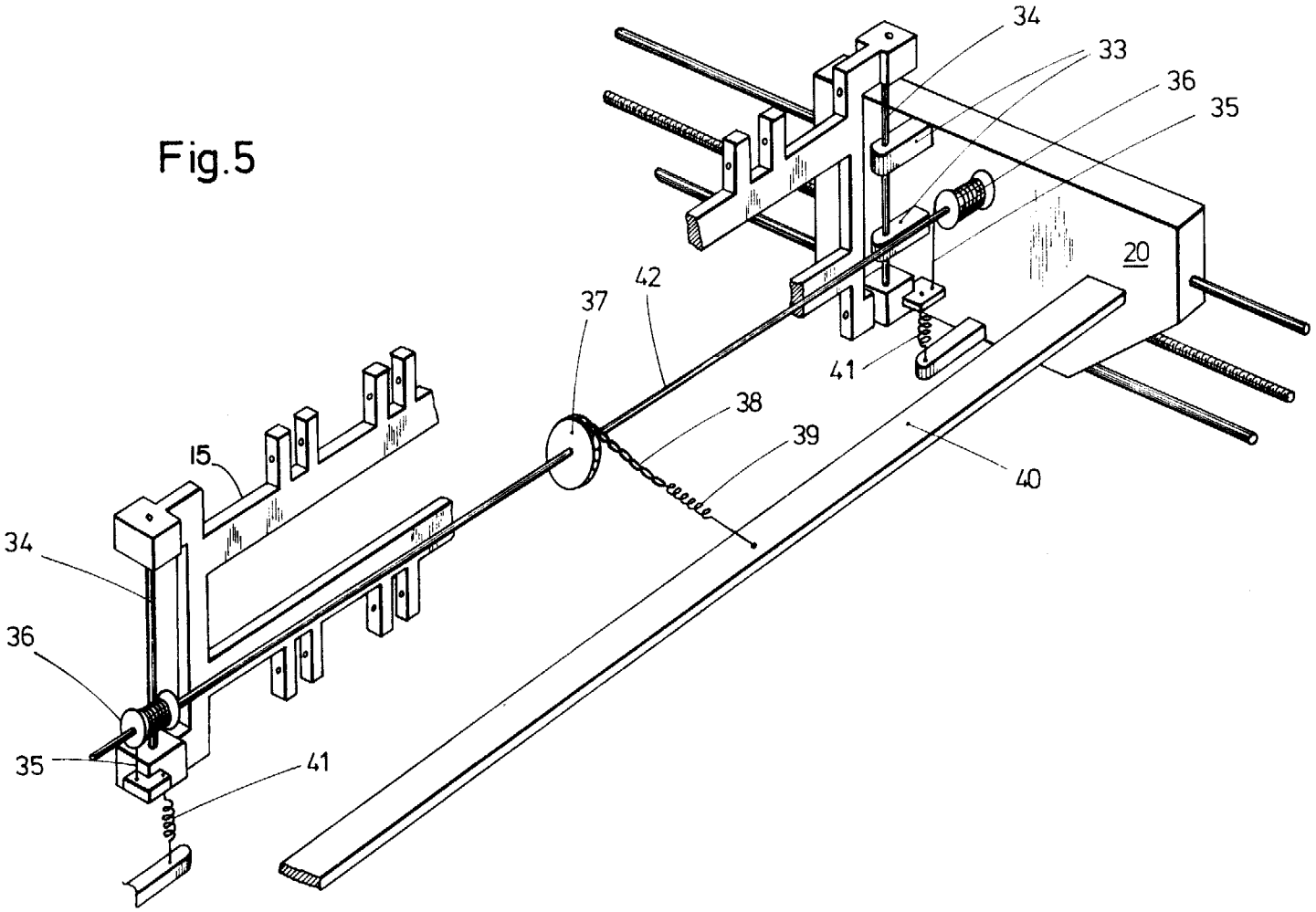
FIG. 5 is a perspective elevation of a support frame mounted in a vertical guide means.

A lower tool group 32 is illustrated in FIGS. 2, 4 and 5 together with the associated support frame. The upper tool group 14 includes finishing grinding units, while the grinding units in the lower tool group 32 are equipped for rough grinding. The grinding belt is therefore coarser. The point of engagement of the tools in group 32 on the workpiece is thus in front of that of the upper group 14 so that, when both groups of tools are operating simultaneously, the coarse grinding operation precedes the finishing grinding operation.

The lower tool group 32 is constructed in substantially the same manner as the upper group so that it will be sufficient to concentrate only on the differences. It is to be understood, however, that in the lower tool group the small guide roller is of course provided at the top and the large roller at the bottom. The large guide rollers similar to the upper tool group are driven by a central motor (not shown). The same or corresponding parts have been assigned the same reference numerals.

The lower tool group differs in that the support frame 15 is mounted in the lateral vertical guides 33 of the guide shears 20 to be reciprocated up and down in a strictly vertical direction. For this purpose, the support frame has on both sides a vertical guide rod 34 which passes through the vertical holes in the vertical guides 33. The support frame can be moved up and down in a vertical direction owing to this guide system. It goes without saying that when a load is exerted on the support frame, this must be pushed upwardly. This is accomplished with the aid of a different compensation system than in the upper tool group 14.

The support frame is connected on both sides with a traction element 35 consisting of a rope which is conveyed upwardly onto a wind-up roller 36 in each case. The wind-up rollers are located on a shaft which is rotatably mounted and wedged in position between the two guide shears 20. A chain wheel or sprocket 37 to which a chain 38 is secured at its one end is located in the vertical plane E and is secured to the shaft in a non-rotatable manner. At the other end the chain which encircles the sprocket in a clockwise manner is attached to the pre-biasing spring 39. This spring is aligned approximately horizontally in plane E and has its other end attached to a support 40 extending transversely to the longitudinal direction L of the workpieces from one guide shear 20 to the other. The pre-biasing spring 39 imparts to the shaft a torque which is oriented such that the wind-up rollers 36 are biased in the winding-up direction and the frame as a whole is urged upwardly.

The pre-biasing spring 39 is counteracted at both ends of the support frame by a counteracting spring 41 in each case which itself is secured to the support frame on the one hand and to the guide shears 20 on the other. The counteracting springs act to compensate the load exerted on the support frame and impart the necessary stability to the control system.

Both tool groups were equipped with grinding units in the present case. It is just as feasible, however, to substitute other tools for the belt grinding or milling units without departing from the spirit of the invention.

In machining the workpieces, both tool groups 14 and 32 move simultaneously from one end of the workpieces to the other together with the guide shears, the support frame, etc. This movement occurs from right to left in the present case as illustrated in FIGS. 1 and 2. During the machining operation, the workpieces 2 and the pattern 8 are rotated about their axes synchronously so that they are machined (or traced) over their entire external surface. FIG. 2 shows that the lower tool group 32 advances in front of the upper group by a constant spacing x during operation. The copying rollers trace the patterns, thereby regulating the copying movements of the tool groups. The pre-biasing springs cause the copying rollers to abut against the patterns at all times. The counteracting springs stabilize the control system.

What is claimed is:

1. In a contour copying machine having means for supporting at least one pattern and at least one workpiece rotatably about parallel respective pattern and workpiece longitudinal axes, means for synchronously rotating said pattern and said workpiece about said respective axes, at least one copying roller engageable with said pattern and at least one tool engageable with said workpiece, said copying roller and said tool being rigidly interconnected and synchronously movable along said respective longitudinal axes, and means for urging said copying roller and said tool against said pattern and said workpiece, respectively, for machining said workpiece and accurately reproducing therein the contours of said pattern, the improvement comprising:

a rigid support frame for supporting and rigidly interconnecting said copying roller and said tool in proximate relation to one another, traction means connected to said support frame at points thereon situated symmetrically with respect to said copying roller, and biasing means operatively connected to said traction means, said means for urging said copying roller and said tool against said pattern and said workpiece, respectively, including said support frame, said traction means and said baising means.

2. A contour copying machine as claimed in claim 1, wherein said biasing means includes a spring.

3. A contour copying machine as claimed in claim 1, wherein said traction means comprises a pair of traction elements, each end region of said support frame being connected to one of said traction elements.

4. A contour copying machine as claimed in claim 1 or 3, wherein the copying roller is situated at the center of said support frame.

5. A contour copying machine as claimed in claim 1, wherein said biasing means is situated in a vertical plane lying parallel to the longitudinal axis of said workpiece and extending along the longitudinal axis of said pattern.

6. A contour copying machine as claimed in claim 1, wherein said traction means comprise at least one rope.

7. A contour copying machine as claimed in claim 1, further comprising first and second guide means situated on opposite sides of the machine for guiding said support frame, and first and second guide shears movably mounted on said first and second guide means, respectively, said support frame being movably mounted on, and extending between, said first and second guide shears and being aligned transversely to the longitudinal axis of said workpiece.

8. In a contour copying machine having means for supporting at least one pattern and at least one workpiece rotatably about parallel respective pattern and workpiece longitudinal axes, means for synchronously rotating said pattern and said workpiece about said respective axes, at least one copying roller engageable with said pattern and at least one tool engageable with said workpiece, first and second guide means situated on opposite sides of the machine, first and second guide shears movably mounted on said first and second guide means, respectively, for supporting said copying roller and said tool, said copying roller and said tool being rigidly interconnected and synchronously movable, together with said first and second guide shears, along the longitudinal axis of said workpiece, and means for urging said copying roller and said tool against said pattern and said workpiece, respectively, for machining said workpiece accurately and reproducing therein the contours of said pattern, the improvement comprising:

(a) a rigid support frame movably mounted on, and extending between, said first and second guide shears for supporting and rigidly interconnecting said copying roller and said tool in proximate relation to one another, said support frame being aligned transversely to the longitudinal axis of said workpiece;

(b) traction means connected to said support frame at points thereon situated symmetrically with respect to said copying roller; and (c) biasing means operatively connected to said traction means, said means for urging said copying roller and said tool against said pattern and said workpiece, respectively, including said support frame, said traction means and said biasing means; the improvement further comprising a brace extending between and rigidly connecting said first and second guide shears, said biasing means being secured to said brace.

9. A contour copying machine as claimed in claim 8, further comprising a pair of wind-up rollers rigidly secured at the opposite end regions of a shaft rotatably mounted on and between said guide shears, each of said wind-up rollers having said traction means wound thereon.

10. A contour copying machine as claimed in claim 9, further comprising force transmission means rigidly secured to said rotatable shaft, said biasing means being operatively connected to said force transmission means for rotatably biasing said shaft.

11. A contour copying machine as claimed in claim 8, further comprising counterbalancing means secured to said support frame and said guide shears for partially counteracting the biasing force exerted on said support frame by said biasing means and said traction means.

12. A contour copying machine as claimed in claim 1 or 8, further comprising at least two guide bars pivotably mounted between said support frame and at least one of said guide shears for guiding said support frame as said copying roller and said tool mounted thereon are urged against said pattern and said workpiece, respectively, said guide bars extending substantially parallal to one another.

13. A contour copying machine as claimed in claim 12, wherein a first pair of said guide bars is pivotably mounted between one end region of said support frame and one of said guide shears and a second pair of said guide bars is pivotably mounted between the opposite end region of said support frame and the other of said guide shears.

14. A contour copying machine as claimed in claim 8, wherein said support frame is mounted on said guide shears for reciprocal movement in a substantially vertical plane.

* * * * *